United States Patent [19]

Bosley

[11] 4,096,222

[45] Jun. 20, 1978

[54] PROCESS OF TREATING POLYESTER YARN TO PROVIDE A PATTERN OF PORTIONS THAT DIFFER IN DYEABILITY

[75] Inventor: David Emerson Bosley, Grifton, N.C.

[73] Assignee: E. I. Du Pont de Nemours and Company, Wilmington, Del.

[21] Appl. No.: 677,990

[22] Filed: Apr. 19, 1976

[51] Int. Cl.[2] ..... D01D 5/20

[52] U.S. Cl. ..... 264/78; 57/140 J; 264/167; 264/210 F; 264/290 T; 428/369; 428/399

[58] Field of Search ..... 264/167, 210 F, 290 T, 264/78; 57/140 J; 428/369, 399

[56] References Cited

U.S. PATENT DOCUMENTS

| | | | |
|---|---|---|---|
| 3,363,295 | 1/1968 | Allen | 28/75 |
| 3,478,143 | 11/1969 | Werner et al. | 264/290 T |
| 3,591,672 | 7/1971 | Davies et al. | 264/167 |
| 3,771,307 | 11/1973 | Petrille | 57/157 TS |
| 3,949,041 | 4/1976 | Schwarz | 264/290 T |
| 3,979,496 | 9/1976 | Schwarz | 264/210 F |

*Primary Examiner*—Jay H. Woo

[57] ABSTRACT

Polyester yarn having portions which differ in dye uptake, arranged along its length in a predetermined pattern, is produced by treating portions of a spin-oriented yarn with a fluid to induce crystallization and then drawing the yarn to provide a product having a break elongation appropriate for the intended use. The spin-oriented yarn is preferably prepared by melt-spinning polyethylene terephthalate into yarn while withdrawing the yarn from the spinneret at a take-off speed of 3000 to 4000 yards per minute. Suitable treating fluids include acetone or methylene chloride at room temperature and water or air at elevated temperatures. The treated yarn can be draw-textured on false-twist texturing machines having heaters at temperatures above 200° C. The treated portions of the yarn dye deeper than the untreated portions to provide attractive effects in dyed fabrics.

7 Claims, 2 Drawing Figures

PROCESS OF TREATING POLYESTER YARN TO PROVIDE A PATTERN OF PORTIONS THAT DIFFER IN DYEABILITY

BACKGROUND OF THE INVENTION

This invention relates to productions of falsetwist textured yarn of polyester filaments, and is more particularly concerned with polyester yarns having a predetermined pattern along the yarn of portions which will dye more deeply than other portions of the yarn.

Conventional processes used for producing polyester textile yarns have involved the steps of melt-spinning polyethylene terephthalate into yarn at take-off speeds of 550 to 1640 yards per minute (500 to 1500 meters/minute) and drawing the as-spun yarn at a draw ratio of about 3.5 to 4.5X to produce fully drawn, uniform yarn. The take-off speed refers to the speed of the solidified as-spun yarn at windup or a roll for forwarding the yarn to subsequent processing. Adams U.S. Pat. No. 3,155,754 discloses uniform treatment of the as-spun yarn with various liquids for 0.2 second to about 3.0 seconds with immediate removal of the treating liquid, and then drawing the yarn, to make the yarn more receptive to dyes. Suitable liquids are defined as ones which effectively lower the drawing tension when tested by contacting the yarn with the test liquid for one minute, rinsing with water and then immediately drawing the yarn. The patent describes the treated and drawn filaments as having a sheath-core structure in which the core is that of a normal oriented crystalline polyester filament while the sheath, although crystalline, has less orientation than the core and is considerably easier to dye.

Yarn which will dye non-uniformly is frequently desirable to provide an enlivened, variegated appearance in apparel and upholstery fabrics. Werner et al. U.S. Pat. No. 3,478,143 discloses a process of incompletely drawing conventional as-spun yarn to provide a random distribution of thick and thin sections along the filaments. The thick sections are only slightly drawn and dye more deeply than the thin sections, which are substantially fully drawn. The ratio of the average denier or cross-sectional area of the thick sections to that of the thin sections is nearly as large as the draw ratio used (drawn ratios of 2.8X to 3.37X are disclosed in the examples). This amount of denier fluctuation can cause difficulty in processing the yarn into fabric and the fabric is less resistant to abrasion than would be the case with a more uniform yarn. Also, when the yarn is false-twist textured, the thick incompletely-drawn sections melt and fuse together at heater temperatures of over 200° C (needed to obtain good crimp) and fully satisfactory products cannot be made.

Petrille U.S. Pat. No. 3,771,307 discloses that as-spun polyester yarn can be draw-textured on false-twist texturing machines at heater plate temperatures of 227° C when using spin-oriented yarn prepared by melt-spinning at take-off speeds of 3000 to 4000 yards per minute (2744 to 3660 meters/minute). The as-spun yarn is drawn at a draw ratio of 1.3 to 2.0 which is sufficient to provide a fully drawn, uniform yarn. However, the patent does not disclose how to produce polyester yarn having portions which will dye more deeply than other portions.

SUMMARY OF THE INVENTION

The present invention provides a process for producing polyester yarn having a predetermined distribution along the yarn of portions which dye more deeply than other portions of the yarn and are of only slightly greater denier than the other portions of the yarn. Furthermore, the invention provides a process for producing such yarn that is suitable for false-twist texturing at heater temperatures of over 200° C. The invention also provides a process for producing such yarn in textured form which includes the step of draw-texturing on a false-twist texturing machine at heater temperatures of over 200° C. Other advantages of the invention will become apparent hereinafter.

The process is an improvement in processes of drawing yarn at a lower draw ratio than would be used to produce a uniform fully-drawn yarn, in order to provide alternating thick and thin portions along the yarn that differ in dyeability, i.e., thick portions that dye more deeply than thin portions. The improvement of the present invention comprises treating as-spun spin-oriented polyester yarn at intervals along its length with a fluid to induce crystallization in predetermined portions of the yarn, the treatment being sufficient to provide a force-to-draw value of at least 1.12 (preferably 1.2 to 1.6) times the value for untreated portions and a density difference of more than 0.005 (preferably 0.020 to 0.040), and then drawing the yarn to have treated portions of 4 to 20 percent greater denier than the untreated portions.

As used herein, "as-spun spin-oriented polyester yarn" refers to continuous filament yarn prepared by melt-spinning polyester and withdrawing the yarn from the spinneret at a take-off speed of 3000 to 4000 yards per minute (2740 to 3660 meters/minute), where the take-off speed refers to the speed of the solidified yarn at windup or at a roll for forwarding the yarn to subsequent processing. Polyester consisting essentially of linear glycol terephthalate polymer is suitable. Polyethylene terephthalate is preferred. The polyester may contain the usual delustrants, particulate matter, antistats, optical brighteners, antioxidants and copolymer components.

The treating fluid may be any liquid or gas which does not damage the yarn under the conditions used. Organic liquids disclosed as suitable for use in the process of Adams U.S. Pat. No. 3,155,754 may be used in the present process. Fluids which are not effective at room temperature become suitable at elevated temperatures, e.g., hot water (90 to 100° C), steam and hot air (160° ) are useful, as illustrated in Example II. Acetone and methylene chloride are preferred fluids for use at room temperature.

The treating fluid is applied to portions of the yarn for sufficient time to accomplish the specified increases in force-to-draw and density indicated. Measurement of these values is described subsequently. Portions of the yarn can be immersed in a volatile treating liquid until thoroughly wet and the liquid then be allowed to evaporate as illustrated in Example I. Portions of the yarn can be immersed in a hot fluid until thoroughly heated and the yarn can then be allowed to cool. A treatment time of five minutes is generally adequate but, as illustrated in Example II, longer treatments may be desirable. Liquids which are not desirable during subsequent processing of the yarn can be removed by washing and drying the yarn after sufficient treatment.

The treated yarn is drawn according to conventional procedures used for as-spun spin-oriented polyester yarn, except that smaller draw ratios should be used since the treated portions do not draw to the same extent as the untreated portions. The draw ratio should be adjusted so that the denier of the treated portions in the drawn yarn is 4 to 20 percent greater than the denier of the untreated portions. The drawing operation can be followed by false-twist texturing at a heater temperature of over 200° C for setting twist in the yarn. Preferably the two steps are combined in a simultaneous draw-texturing process on a false-twist texturing machine as illustrated in Example I. The treated portions of the yarn do not melt or stick together.

Figure 1:
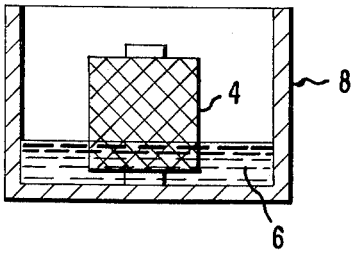
FIG. 1 is a schematic side view of a procedure for treating as-spun yarn with a liquid to induce crystallization in portions of the yarn.

One method of treating a package of as-spun spin-oriented yarn to induce crystallization in predetermined portions of the yarn is illustrated in FIG. 1. Package 4 of the yarn is partially immersed in bath 6 of liquid crystallization agent contained in tank 8. The angle of wrap of the yarn on the package, and the depth of immersion in the liquid, are adjusted so that the portions of yarn contacting the liquid are of the desired length and periodicity along the yarn. The package can be immersed in the liquid until sufficient crystallization occurs in the predetermined portions of yarn. Alternatively, the package can be immersed until the portions of yarn are thoroughly wet with the liquid, then be removed and the liquid allowed to remain on the yarn at least until sufficient crystallization occurs. The treatment should be long enough to provide the specified force-to-draw and density difference characteristics.

In a similar manner, an end of a package can be exposed to steam or hot air to induce crystallization in predetermined portions of the yarn.

Figure 2:
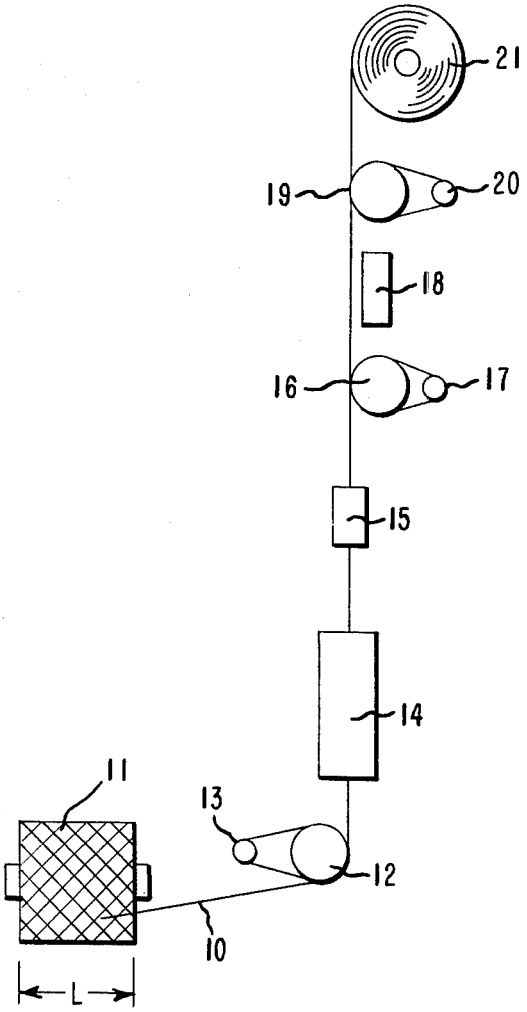
FIG. 2 is a schematic side view of draw-texturing yarn after treatment, e.g., after treatment as in FIG. 1.

The treated yarn is then drawn so that the treated portions have 4 to 20 percent greater denier than the untreated portions, which draw to a greater extent. The drawn yarn can then be false-twist-textured in a separate operation. Preferably, drawing and texturing are combined as illustrated in FIG. 2. The treated yarn 10 from package 11 wraps around feed roll 12 and associated roller 13, passes by texturing heater 14, is twisted by false-twister 15, passes to draw roll 16 and associated roller 17, passes by a second heater 18 (optional), around package feed roll 19 and associated roller 20, and is wound up on package 21. The yarn is drawn between rolls 12 and 16.

TEST METHODS

Measurements indicated in the examples are determined as follows:

Break Elongation and Tenacity are measured according to the ASTM designation D-2256-69 (incorporating editorial edition of Section 2 and renumbering of subsequent sections as done in March 1971). It is defined as in Option 3.3 "Elongation at Break" of Section 3. The testing is performed on straight multifilament yarns which were conditioned by storing them at 65 percent relative humidity and 70° F (21.1° C) for 24 hours prior to testing. An Instron Tensile Testing Machine is used. The test sample is 5 inches (12.7 cm) long, no twist is added, the cross-head speed is 10 inches/minute (25.4 cm/min), the rate of attenuation is 200 percent/minute, and the chart speed is 5 inches/minute (12.7 cm/min). Tenacity is the maxium load in grams, before the yarn breaks, divided by the denier of the yarn.

Boil-off Shrinkage is obtained by suspending a weight from a length of yarn to produce a 0.1 gm/denier load on the yarn and measuring its length ($L_o$). The weight is then removed and the yarn is immersed in boiling water for 30 minutes. The yarn is then moved, loaded again with the same weight, and its new length recorded ($1_{71}$). The percent shrinkage is calculated by using the formula:

$$\text{Shrinkage (\%)} = (L_o - L_{71})/L_o \times 100$$

Relative Viscosity (RV) values of the polyesters used in the examples are given as a measure of the molecular weight. Relative Viscosity (RV) is the ratio of the viscosity of a solution of 0.8 gm. of polymer dissolved at room temperature in 10 ml of hexafluoroisopropanol, to the viscosity of the hexafluoroisopropanol itself, both measured at 25° C in a capillary viscometer and expressed in the same units.

Birefringence is measured by the retardation technique described in "Fibres from Synthetic Polymers" by R. Hill (Elsevier Publishing Company, New York, 1953), pages 266–268, using a polarizing microscope with rotatable stage together with a Berek compensator or cap analyzer and quartz wedge. The birefringence is calculated by dividing the measured retardation by the measured thickness of the fiber, expressed in the same units as the retardation. For samples in which the retardation technique is difficult to apply because of non-round fiber cross section, presence of dye in the fiber, etc., an alternative birefringence determination such as Becke line method described by Hill may be employed.

Density, used as an indication of crystallinity, may be determined by the method described in "Physical Methods Investigating Textiles", R. Meridith and J. W. S. Hearle, Textile Book Publishers, Inc. (1959) pages 174–176. Carbon tetrachloride and n-heptane are suitable liquids for use with polyethylene terephthalate. Density difference is the density of the treated portion of the yarn minus the density of the untreated portions.

Force-to-draw is the force required to draw a portion of the yarn 1.536X over a hot plate heated to 210° C. It is measured as follows:

The yarn to be tested is withdrawn from the bobbin; passed around two parallel rolls which rotate at a surface speed of 50 feet/minute (15.2 meters/minute). A sufficient number of wraps are taken to insure that there is no slippage. The yarn is passed through a strain gauge, thence over and just in contact with a heated, low friction 4.7-inch (about 12 cm) long hot plate at 210° C, over a second pair of draw rolls rotating at a speed of 76.8 feet/minute (23.4 meters/minute) to draw the yarn 1.536X and finally to a yarn take-up system. The length of yarn between the feed rolls and draw rolls is about 4 feet (about 122 cm). Again, enough wraps are taken on the draw rolls to insure that there is no slippage. The "force-to-draw" is measured by the strain gauge and appropriately recorded.

Deep-dyeing sections are portions of the textured yarn which take up more disperse dye than adjacent portions when exposed to identical dyeing conditions.

EXAMPLE I

A 235-denier spin-oriented polyester yarn is prepared by melt spinning at 284° C, 20RV polyethylene terephthalate using a spinneret having 34 round orifices (each orifice 0.28 mm wide, 0.51 mm deep) and winding the filaments at 3107 mpm (3398 ypm). The yarn is interlaced during its travel to the windup as shown in U.S. Pat. No. 2,985,995 to a pin count (the length of yarn in inches that passes by probe 18 of Hitt U.S. Pat. No. 3,290,932 before the probe is deflected about 1 mm. A force of about 8 gms is required to deflect the probe) of 40 cm. The yarn has a birefringence of 0.038, a tenacity of 2.2 gpd, a break elongation of 120%, and a boil-off shrinkage of 55%. The yarn is wound on a conventional 6-cm diameter, 28-cm long cylindrical paper tube to form a package. The yarn is wound on the package at a helix angle of 7°. The package weighs 4.5 kg. has an outside diameter of 17 cm and a length (corresponding to "L" in FIG. 2) of 24.5 cm. The package is dipped into a bath of acetone to a depth of 0.5 cm for 2 seconds. It is then withdrawn from the acetone and allowed to dry in air. The treated yarn sections (deep-dyeing sections) have a force-to-draw of about 50 grams and the other sections have a force-to-draw of about 40 grams.

The treated spin-oriented yarn is draw-textured using a draw ratio of 1.60 on a 440 ARCT false-twist-texturing machine modified to draw the yarn in the texturing zone, using the following conditions: 59.5 meters/min feed speed, 14% second overfeed, 0% supplementary overfeed, −4% takeup overfeed, 2598 turns per meter twist; 247,323 rpm spindle speed; 210° C first heater; 230° C second heater; and a cooling zone stringup. No melting occurs in the texturing zone. The textured yarn is knit into a single-feed jersey on a Lawson-Hemphill FAK knitter and dyed with Latyl® Blue FLW. The resulting fabric has an attractive variegated appearance.

EXAMPLE II

Spin-oriented yarn is prepared as in Example I except that each spinneret orifice is about 0.38 mm diameter and about 1.52 mm deep and the windup speed is 3200 mpm. Several packages of yarn are treated with several crystalinducing systems. Each package is treated as explained in the table, removed from the treating medium and allowed to condition for about 4 days at 65% relative humidity and 72° F before testing. Force-to-draw and density of treated and untreated portions of each yarn are then measured. Results are shown in the table. The treated portions have higher force-to-draw and higher density (higher crystallinity) than the untreated portions.

Each yarn is simultaneously drawn and textured on a Leesona 570 texturing machine at the following conditions: draw-texturing draw ratio 1.468, spindle speed 240,000 rpm, relaxation on second heater 12-¼%, 66 turns per inch (26 turns/cm) in the yarn, bottom heater temperature 180° C, top heater temperature 190° C. Each textured yarn is knit into a jersey plain stitch circular tube on a Lawson-Hemphill FAK Knitter. A knit swatch from each yarn is scoured and dyed at the boil using 2% Latyl Blue FLW and 2 gm/liter (of water) "Carolid" dye assist. pH is adjusted to about 6.0 with acetic acid. All fabrics from the yarns of the invention have an attractive variegated appearance, the result of the deeper dyeing sections of the new yarn contrasting with the lighter dyed background yarn. Examination of the fabric shows that length of deeper dyeing sections can be controlled by the depth to which the spin-oriented yarn bobbin is immersed in the crystallizing media, and, to a lesser extent, the draw-texturing draw ratio used.

TABLE

| | A | B | C | D | E | F | G | H |
|---|---|---|---|---|---|---|---|---|
| Identification of Feed Yarn | (Control) | | | | | | | |
| Denier | 245 | Same as A | Same as A | Same as A | Same as A | Same as A | Same as A | 235 |
| Treatment of Feed Yarn | Control No treatment | One end of package ½" deep submerged in boiling water for 5 minutes | One end of package ¾" exposed in oven at 160° C for 5 minutes | Ditto of C except exposure for 10 minutes | Each end of package ¾" dipped in acetone for 5 minutes | Ditto of E except only one end wet in acetone | One end of package treated with atm. steam for 5 minutes | One end of package treated with $MeCl_2$ for 5 minutes |
| Force-to-Draw of Feed Yarn | | | | | | | | |
| treated sections | 40 | 68 | 60 | 75 | 51 | 50 | 51 | 60 |
| untreated sections | 40 | 40 | 42 | 48 | 41 | 41 | 45 | 47 |
| ratio treated/untreated | 1.0 | 1.7 | 1.43 | 1.56 | 1.21 | 1.22 | 1.14 | 1.28 |
| Density of Feed Yarn | | | | | | | | |
| treated sections | 1.3442 | 1.3776 | 1.3702 | 1.3793 | 1.3712 | 1.3697 | 1.3489 | 1.3864 |
| untreated sections | 1.3439 | 1.3438 | 1.3436 | 1.3438 | 1.3447 | 1.3436 | 1.3434 | 1.3467 |
| Subjective Rating of Lawson Knit Tubing from Draw-Textured Yarn | | | | | | | | |
| Amount of deep dye sections (5 very numerous, 1 few, 0 none) | 0 | 5 | 3 | 5 | 4 | 3 | 1 | 5 |
| Denier Differences Between Deep Dye and Light Dye Sections of Textured Yarns | | | | | | | | |
| % Denier variation (measured on Uster Evenness Tester) | 1.3 | 5 | 6 | 9.0 | 12 | 10 | 4.5 | 16 |

I claim:

1. In a process for producing polyester yarn having alternating thick and thin portions along the yarn that differ in dyeability, wherein the yarn is drawn at a lower draw ratio than would be used to produce a fully-drawn yarn, the improvement which comprises treating as-spun spin-oriented polyester yarn by contacting the yarn at intervals along its length with a fluid to induce crystallization in the contacted portions of the yarn, the treatment being sufficient to provide in the contacted portions a force-to-draw value of at least 1.12 times the value for untreated portions and a density difference of more than 0.005, and then drawing the yarn to have 4 to 20 percent greater denier in the contacted portions than in the untreated portions.

2. A process as defined in claim 1 wherein the treated yarn is drawn and false-twist textured at a heater temperature of over 200° C for setting twist in the yarn.

3. A process as defined in claim 1 wherein the yarn is drawn and false-twist textured by a simultaneous draw-texturing process.

4. A process as defined in claim 1 wherein as-spun spin-oriented yarn of polyethylene terephthalate is contacted at intervals along its length with acetone for at least five minutes and is then draw-textured, using a draw ratio which provides 4 to 20 percent greater denier in the contacted portions than in the untreated portions of the yarn.

5. A process as defined in claim 1 wherein as-spun spin-oriented yarn of polyethylene terephthalate is contacted at intervals along its length with methylene chloride for at least five minutes and is then draw-textured, using a draw ratio which provides 4 to 20 percent greater denier in the contacted portions than in the untreated portions of the yarn.

6. A process as defined in claim 1 wherein as-spun spin-oriented yarn of polyethylene terephthalate is contacted at intervals along its length with boiling water for at least five minutes and is then draw-textured, using a draw ratio which provides 4 to 20 percent greater denier in the contacted portions than in the untreated portions of the yarn.

7. A process as defined in claim 1 wherein as-spun spin-oriented yarn of polyethylene terephthalate is contacted at intervals along its length with hot air at about 160° C for at least five minutes and is then drawtextured, using a draw ratio which provides 4 to 20 percent greater denier in the contacted portions than the untreated portions of the yarn.

* * * * *

UNITED STATES PATENT OFFICE

CERTIFICATE OF CORRECTION

PATENT NO. : 4,096,222

DATED : June 20, 1978

INVENTOR(S) : David Emerson Bosley

It is certified that error appears in the above-identified patent and that said Letters Patent are hereby corrected as shown below:

Column 6, line 64, "a fully" should read --a uniform fully--

Signed and Sealed this

*Tenth* Day of *April 1979*

[SEAL]

*Attest:*

RUTH C. MASON
*Attesting Officer*

DONALD W. BANNER
*Commissioner of Patents and Trademarks*